US009806462B2

(12) United States Patent
Wendt et al.

(10) Patent No.: US 9,806,462 B2
(45) Date of Patent: Oct. 31, 2017

(54) ELECTRICAL CONNECTION TERMINAL HAVING AN INSERT DEVICE FOR PROVIDING A COUNTER-BEARING FOR A TOOL

(71) Applicant: PHOENIX CONTACT GMBH & CO. KG, Blomberg (DE)

(72) Inventors: Andreas Wendt, Berlin (DE); Ralf Beckmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/023,412

(22) PCT Filed: Sep. 23, 2014

(86) PCT No.: PCT/EP2014/070167
§ 371 (c)(1),
(2) Date: Mar. 21, 2016

(87) PCT Pub. No.: WO2015/040227
PCT Pub. Date: Mar. 26, 2015

(65) Prior Publication Data

US 2016/0211612 A1 Jul. 21, 2016

(30) Foreign Application Priority Data

Sep. 23, 2013 (DE) ..... 10 2013 110 481

(51) Int. Cl.
*H01R 4/48* (2006.01)
*H01R 13/639* (2006.01)
*H01R 4/50* (2006.01)

(52) U.S. Cl.
CPC ..... *H01R 13/639* (2013.01); *H01R 4/5008* (2013.01); *H01R 4/4827* (2013.01)

(58) Field of Classification Search
CPC ..... H01R 4/4845; H01R 4/4818; H01R 4/48
(Continued)

(56) References Cited

U.S. PATENT DOCUMENTS 4,729,738 A * 3/1988 Heng ..... H01R 4/2433 439/395
5,810,628 A 9/1998 Trudel et al.
(Continued)

FOREIGN PATENT DOCUMENTS

DE 19529028 A1 1/1997
DE 202006013216 U1 11/2006
(Continued)

*Primary Examiner* — Tho D Ta
*Assistant Examiner* — Thang Nguyen
(74) *Attorney, Agent, or Firm* — Leydig, Voit & Mayer, Ltd.

(57) ABSTRACT

A connection terminal for the electrically contacting connection of a conductor to a current bar which is accommodated on a holder includes a clamping spring having a first limb and a second limb, said clamping spring being provided for applying a clamping force for damping the conductor. An actuation device which comprises the clamping spring is provided. Between the first limb and the second limb of the clamping spring, which is in the form of a tension spring, is arranged an insert device which provides a counter-bearing for a tool when the actuation device is actuated.

20 Claims, 5 Drawing Sheets

(58) Field of Classification Search
USPC ..... 439/834, 441, 436
See application file for complete search history.

(56) References Cited

U.S. PATENT DOCUMENTS

| | | | | |
|---|---|---|---|---|
| 5,915,991 | A * | 6/1999 | Roman | H01R 4/4827 439/441 |
| 6,065,996 | A | 5/2000 | Bechaz et al. | |
| 7,625,253 | B2 * | 12/2009 | Eppe | H01R 4/4836 439/835 |
| 7,762,834 | B2 * | 7/2010 | Schrader | H01R 4/4836 439/441 |
| 2003/0194918 | A1 * | 10/2003 | Fricke | H01R 4/4818 439/835 |
| 2006/0063420 | A1 * | 3/2006 | Reibke | H01R 4/4827 439/441 |
| 2006/0128206 | A1 * | 6/2006 | Oesterhaus | H01R 4/4836 439/441 |
| 2007/0099479 | A1 * | 5/2007 | Holterhoff | H01R 4/4836 439/441 |
| 2010/0081316 | A1 * | 4/2010 | Eppe | H01H 1/5844 439/441 |
| 2010/0173531 | A1 * | 7/2010 | Holste | H01R 4/4836 439/700 |
| 2014/0134892 | A1 | 5/2014 | Wendt | |

FOREIGN PATENT DOCUMENTS

| | | | |
|---|---|---|---|
| DE | 102005048972 | A1 | 4/2007 |
| EP | 1432075 | A1 | 6/2004 |
| FR | 2782196 | A1 | 2/2000 |
| JP | 2008123963 | A | 5/2008 |
| WO | WO 2013004343 | A1 | 1/2013 |

* cited by examiner

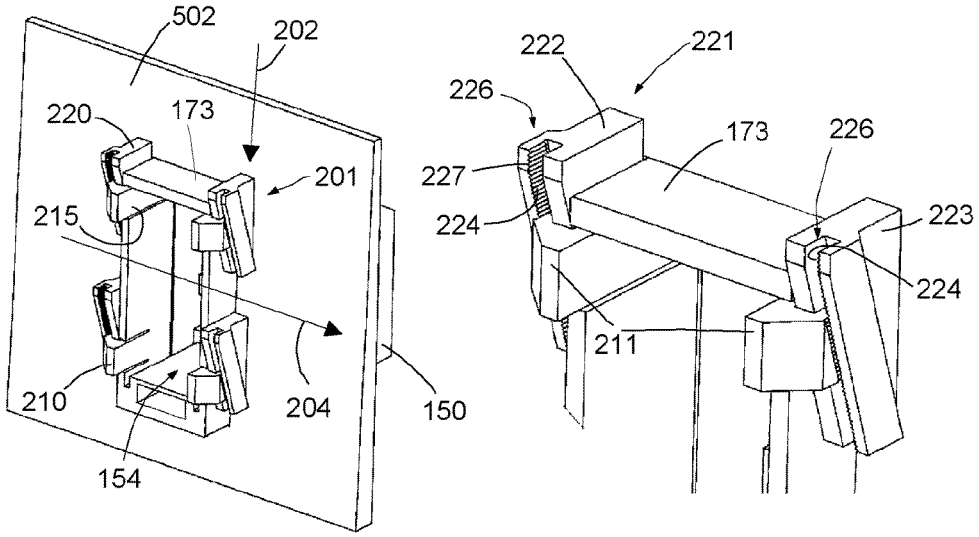
Fig. 4
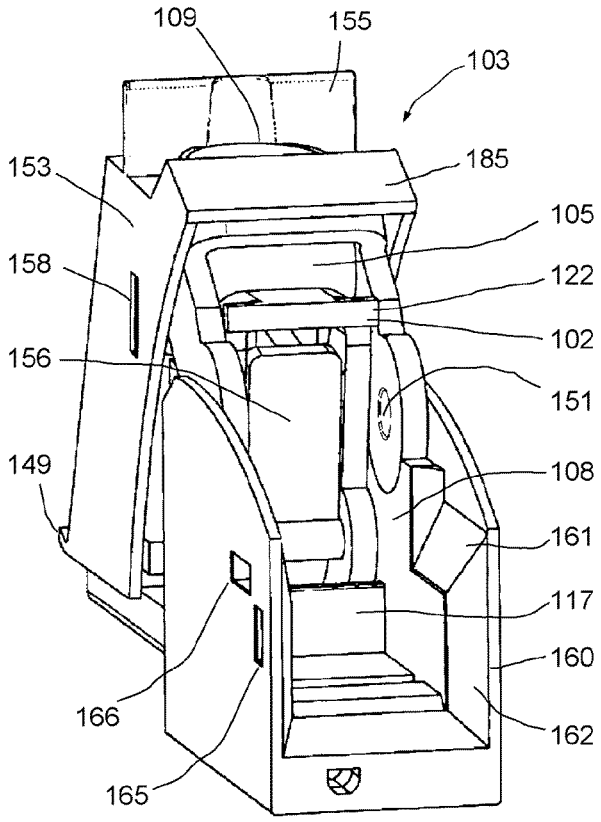
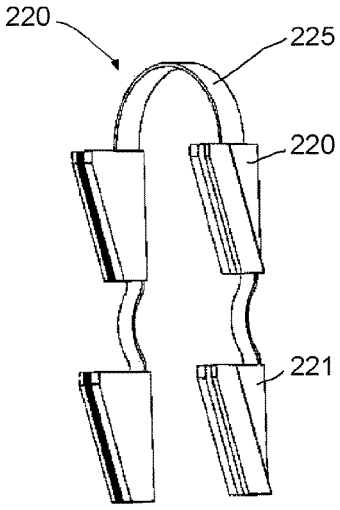
Fig. 5
Fig. 6

ELECTRICAL CONNECTION TERMINAL HAVING AN INSERT DEVICE FOR PROVIDING A COUNTER-BEARING FOR A TOOL

CROSS-REFERENCE TO RELATED APPLICATIONS

This application is a U.S. national stage application under 35 U.S.C. §371 of International Application No. PCT/EP2014/070167, filed on Sep. 23, 2014, and claims benefit to German Patent Application No. DE 10 2013 110 481.9, filed on Sep. 23, 2013. The International Application was published in German on Mar. 26, 2015, as WO 2015/040227 A1 under PCT Article 21(2).

FIELD

The present invention relates to an electrical connecting terminal for connecting at least one conductor and, in particular, to an electrical connecting terminal that is also suited for connecting conductors having large cross sections.

BACKGROUND

Various connecting terminals suited for connecting large-diameter conductors have become known in the related art. Thus, for example, large cross-sectioned conductors can be connected to screw terminals. In those approaches, the conductor is clamped via a screw connection to the electrical connecting terminal. Generally, however, screw terminals have the inherent disadvantage of not readily allowing a stripped conductor to be simply pivoted into position from above. This substantially complicates the assembly, particularly when working with large and massive conductors since the conductor must be bent and introduced axially from the front into the screw terminal before it can be clamped.

On the other hand, an easier assembly is possible in the case of an electrical connecting terminal where the requisite clamping force is applied by a clamping spring. A design can then be selected that also allows the conductor to be pivoted into position from above.

The World Patent Application WO 2013/004343 A1 describes such a connecting terminal. In this known electrical connecting terminal, the clamping lever includes a plurality of clamping springs and a clamping foot at the end thereof for clamping a conductor received therein to the current bar. The clamping lever is connected to a manually operated lever that performs the actuation. A dynamic transmission ratio can thereby be achieved during the closing operation, and a high clamping force can be attained. In principle, the known connecting terminal functions satisfactorily. For the actuation, the manually operated lever has a tool receptacle at the front end thereof into which a screwdriver, for example, can be introduced to manipulate the connecting terminal using relatively little force. Although the known connecting terminal generally functions satisfactorily, the actuation can become difficult in many installation situations.

SUMMARY

In an embodiment, the present invention provides a connecting terminal for an electrically contacting connection of at least one conductor to a current bar accommodated on a holder. The connecting terminal includes: an actuating device including a clamping spring in a form of a tension spring having a first limb and a second limb, the clamping spring being configured to apply a clamping force for clamping the conductor; and an insert device disposed between the first limb and the second limb of the clamping spring, the insert device configured to provide a counter bearing for a tool in response to the actuation of the actuating device.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 4 a schematic perspective view of a wall of an electrical component having a terminal enclosure accommodated thereon and an enlarged detail view;

FIG. 5 another latching unit for the terminal enclosure according to FIG. 4;

FIG. 6 a schematic perspective view of an opened connecting terminal without an outer enclosure;

DETAILED DESCRIPTION

Figure 1:
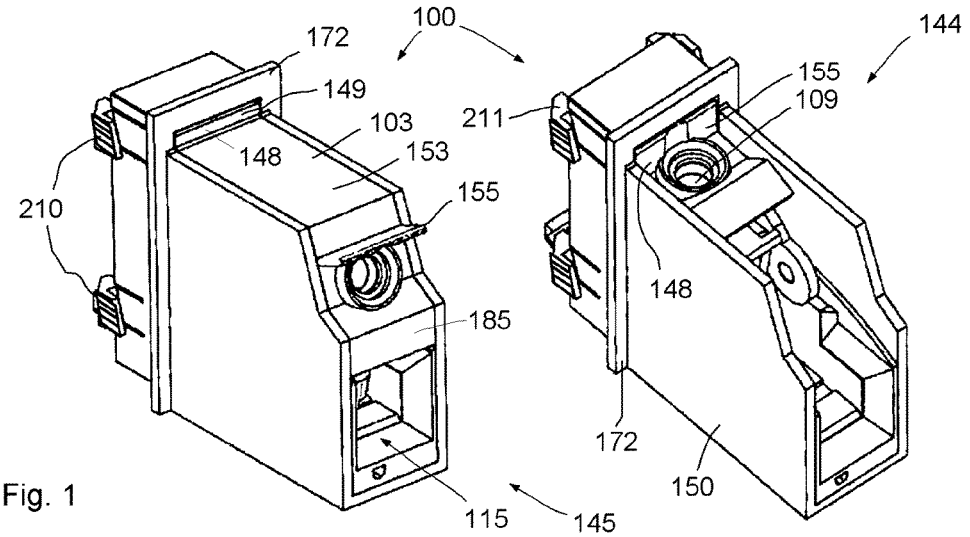
FIG. 1 a perspective view of a connecting terminal in the contact and open position.

An aspect of the present invention provides a connecting terminal that allows different types of installation and operation situations to be taken into account more effectively.

A connecting terminal in accordance with an aspect of the present invention is used for the electrically contacting connection of at least one conductor to a current bar accommodated on a holder. At least one clamping spring having a first limb and a second limb is provided, the clamping spring being provided for applying at least one portion of a clamping force for clamping the conductor. Also provided is an actuating device that includes the clamping spring. Configured between the first limb and the second limb of the clamping spring designed as a tension spring is an insert device. It provides a counter bearing for a tool in response to the actuation of the actuating device.

There are many advantages associated with the connecting terminal in accordance with the present invention. A significant advantage of the connecting terminal according to the present invention is that an insert device, in the form of an insert part, for example, is mounted or accommodated on the actuating device. The insert device provides a counter bearing for a tool, so that a tool, such as a screwdriver, may be used for actuation purposes. The actuation angle, for example, may be influenced by configuring an insert device between the first limb and the second limb of the clamping spring. Installing different insert devices makes it possible to provide an insert device that is suited in each instance for different installation situations. Thus, there may be many variants of the same basic design that are each optimized for different application cases or manufacturing situations. This may be achieved in simple cases by using exchangeable insert devices. The insert device may be exchanged as needed on site, or appropriate connecting terminals may be directly manufactured. At any rate, fewer different parts need to be stocked.

The insert device preferably has a receiving opening for receiving a tool. The receiving opening, respectively the material of the insert device surrounding the same thereby provides the counter bearing. Thus, different insert devices may have different receiving openings for different operating angles. An insert device may also have a plurality of receiving openings, for example, that may serve as a counter bearing, depending on the desired operating angle.

Thus, a flexible use of the connecting terminal according to the present invention is made possible by different insert devices or different receiving openings on an insert device. The field of application may be thereby expanded while the manufacturing costs decrease at the same time since only the appropriate insert devices need to be manufactured in each instance for the different application cases, while the other components of the connecting terminal may be identical or actually at least substantially identical.

A tool opening, through which an actuating tool is introduced, is preferably provided on the clamping spring. In such situations, the clamping spring is not only used to apply the clamping force, but, as a part of the actuating device, also to open or close the connecting terminal.

The inner diameter of the tool opening on the clamping spring is preferably larger than that of the receiving opening of the insert device. This readily facilitates the use of different insert devices that differ in the angle of the receiving opening within the insert device, for example. To a certain extent, the same clamping springs may then be used, although the actuation angle may differ substantially.

Advantageous embodiments provide that the insert device rest at least in one position against the first limb and/or the second limb of the clamping spring. In one such embodiment, the clamping spring, which is approximately C-shaped, especially in cross section, reliably receives the insert device between the limbs thereof. In this way, the insert device is secured between the limbs of the clamping spring.

The clamping spring is designed namely as a tension spring and is tensioned in order to apply the clamping force. An insert device having a massive insert element preferably rests then against the first limb and the second limb in at least in one position of the actuating device. To secure the insert device to the clamping spring even more effectively, it may include an insert element and at least one holding limb that extends away therefrom, thereby forming at least one gap. In such situations, the holding limb preferably rests against a limb of the clamping spring and may be fixed in position there, for example, clamped, adhesively bonded or the like. Analogously, a second contact leg may be provided that extends out away from the insert element, forming a second gap, and rests on the other limb of the clamping spring where it may be fixed in position. The gap between the holding limb and the insert element allows the insert device to engage securely on the limb of the clamping spring, even when there is a change in the length of the clamping spring between the individual actuating positions. An even more reliable operation is thereby ensured.

Preferred embodiments provide a protective cover for covering purposes on the actuating device. An operating opening for introducing and feeding through a tool is preferably provided in the protective cover. The operating opening is oriented on the tool opening of the clamping spring in the same way that the receiving opening is on the insert device. This means that a tool may be introduced through the operating opening of the protective cover and through the tool opening on the clamping spring into the receiving opening in the insert device.

A protective cover makes it possible to mechanically protect the actuating device. This also makes possible a contact protection for the individual components of the actuating device. The protective cover is preferably altogether or at least partially composed of a plastic and preferably of an insulation material. This makes it possible to increase clearances and creepage distances.

Preferred embodiments provide for at least one fixing element on the insert device for fixing the protective cover in position. For example, fixing elements of the protective cover may lock engagingly with fixing elements of the insert device or the like, to secure and, notably, to lockingly engage the protective cover to the actuating device and the insert device to the actuating device. A fixing element may be especially configured as a latching lug.

The actuating device preferably includes a plug-in protection.

The clamping spring preferably has an approximately C-shaped form, the open area between the first limb and the second limb of the clamping spring being oriented toward the conductor receptacle of the connecting terminal. This makes the open area of the "C" of the clamping spring basically accessible from the conductor receptacle. It is, therefore, preferred that the open area between the first limb and the second limb of the clamping spring be covered by the plug-in protection at least partially and, preferably, at least substantially, and especially completely, thereby reliably preventing an improper actuation of the connecting terminal. Moreover, the plug-in protection more effectively protects the inner region of the actuating device including the clamping spring from contacts and the like.

The plug-in protection may be directly mounted on the insert element. The plug-in protection may possibly be a separate component that is joined to the insert element of the insert device, for example. In all of the embodiments, the plug-in protection is preferably joined via a crosspiece to the insert element of the insert device. The plug-in protection is thereby preferably altogether integrally formed with the insert device or with the insert element. The insert device is preferably accommodated at least partially and, in particular, substantially between the two limbs of the clamping spring.

In all of the embodiments, it is especially preferred that the clamping spring be articulated by the first limb to a clamping lever and by the second limb to an auxiliary lever. The clamping lever and the auxiliary lever are preferably pivotably mounted on the holder.

It is also preferred that a first pivot and at least one second pivot, spaced at a distance therefrom, be configured on the clamping lever. The clamping spring preferably has a first pivot receptacle and a second pivot receptacle that is spaced at a distance therefrom. In particular, the first pivot receptacle is provided at the end of the first limb, and the second pivot receptacle is provided at the end of the second limb of the clamping spring. Preferably provided is an auxiliary lever that has a first swiveling unit and at least one second swiveling unit that is spaced at a distance therefrom. This means that the clamping lever, the clamping spring, and, preferably, the auxiliary lever each have two separate, mutually spaced apart points of articulation.

The clamping lever is preferably pivotably fastened to the holder via the first pivot. In particular, the first pivot receptacle of the clamping spring is provided on the first limb of the clamping spring, and the second pivot receptacle of the clamping spring is provided on the second limb of the clamping spring. The first pivot receptacle of the clamping spring configured on the first limb is preferably coupled to the second pivot of the clamping lever.

The first swiveling unit of the auxiliary lever advantageously has a pivot that is pivotably coupled to the second pivot receptacle on the second limb of the clamping spring. In particular, the second swiveling unit of the auxiliary lever is pivotably mounted on the holder.

The second swiveling unit of the auxiliary lever preferably features a rounded outer contour that is pivotably received on an adapted, rounded recess of the holder. It is especially preferred that the outer contour and the recess each feature a circular shape or the shape of a circular segment. In particular, the second swiveling unit of the auxiliary lever is pivotably or rotatably received on the rounded outer contour of the holder and preferably supported thereon.

It is possible and preferred that the second swiveling unit of the auxiliary lever have an opening into which a guide pin is introduced. The second swiveling unit may thereby be rotatably mounted via the guide pin at the opening. However, it is also possible that the guide pin in the opening not be used for transmitting forces, but rather essentially only for guidance. The guide pin may be part of the housing, for example, and be composed of a plastic pin, for example, that is swiveled or clipped into the opening. However, it is also possible that the guide pin be a pin on the holder or, however, be introduced separately into the holder in order to pivotably receive and/or support the auxiliary lever on the second swiveling unit.

In all of the embodiments, it is preferred that the clamping spring be part of the actuating device.

An opening angle on the conductor receptacle between the current bar and the clamping lever in the open state is preferably greater than 45° and, in particular, greater than 60°, preferably greater than 75°. Opening angles of 90° and more are possible on the connecting terminal according to the present invention.

If indicated in another embodiment for which the Applicant is applying for separate protection, the connecting terminal includes a terminal enclosure on which a pivotable actuating device is provided. In a contact position, the actuating device is adapted for clamping a conductor to a conductor receptacle and, in an open position, for releasing and/or receiving a conductor on the conductor receptacle. The actuating device thereby features a clamping spring and a protective cover, which surrounds at least the clamping spring and fixes an insert device in position that is received on the clamping spring. In further embodiments, such a connecting terminal has at least one further feature that was described previously.

In all of the embodiments, the connecting terminal may be configured as a bushing terminal.

The design and function of a connecting terminal 100 and of an electrical component 500 equipped with at least one such connecting terminal are explained in the following with reference to the enclosed figures.

FIG. 1 shows two, side-by-side perspective views of a connecting terminal 100, namely to the left in the clamping state, respectively in contact position 145 and, to the right, in the open state, respectively in open position 144.

Connecting terminal 100 features a terminal enclosure 150 and is provided for engaging on a wall 502 of an electrical component 500 (compare FIG. 2) via installation section 172. In contact position 145, conductor receptacle 115 is substantially closed, while, in open position 144, an especially large opening angle, which may reach 75° or more, is formed between the current bar and the clamping lever. This allows a conductor (compare FIG. 11) to be pivoted into position into conductor receptacle 115. This may considerably simplify the connection, especially for conductors having cross sections of a plurality of square millimeters.

Terminal enclosure 150 is made, in particular, of an electrically non-conductive material and, preferably, of a plastic. Installation section 172 may be provided as a peripheral flange that braces connecting terminal 100 peripherally against wall 502. Installation section 172 may also be composed of a plurality of segments or of individual supporting elements.

Tool opening 109, provided on actuating device 103, is discernible on connecting terminal 100, both in contact position 145, as well as in open position 144. Actuating device 103 includes a protective housing in the form of a protective cover 153. Protective cover 153 is composed here of an insulation material and protects the interior of actuating device 103 and also that of connecting terminal 100 from mechanical contacts. Protective cover 153 considerably increases the clearances and creepage distances as well.

Terminal enclosure 150 may have an outer enclosure 170 and an inner enclosure 160 that accommodates holder 108. Holder 108 is preferably made of metal and, in particular, of a bent stamped part. The outer and inner enclosure are preferably made of a plastic. Holder 108 is accommodated on inner enclosure 160 during assembly, and the requisite metal and clamping parts are assembled. Together with holder 108, the inner enclosure forms a preassembled unit that only still needs to be inserted into outer enclosure 170 or, however, needs to be introduced into or latched into place in an outer enclosure that is already present on an electrical component 500 and is integrally formed there with the wall, for example.

Connecting terminal 100 features pivotable actuating device 103. The connecting terminal may be opened or closed again in response to pivoting of actuating device 103. In response to pivoting of actuating device 103, a gap 148 may form between the peripheral wall of installation section 172 and protective cover 153 of actuating device 103, namely where closure segment 149 is present in contact position 145. If actuating device 103 is pivoted rearwardly from the closed position shown to the left in FIG. 1, then closure segment 149 is pivoted through wall leadthrough 154 and through wall 502 into electrical component 500. At the same time, a gap 148 forms between wall 172 and protective cover 153 where closure segment 149 was previously configured. If pivoting continues into open position 144, gap 148 is finally closed again by deflector 185, so that no gap 148 is present in the open position. Gap 148 is spaced at a distance from conductor receptacle 115 and is independent thereof.

Figure 2:
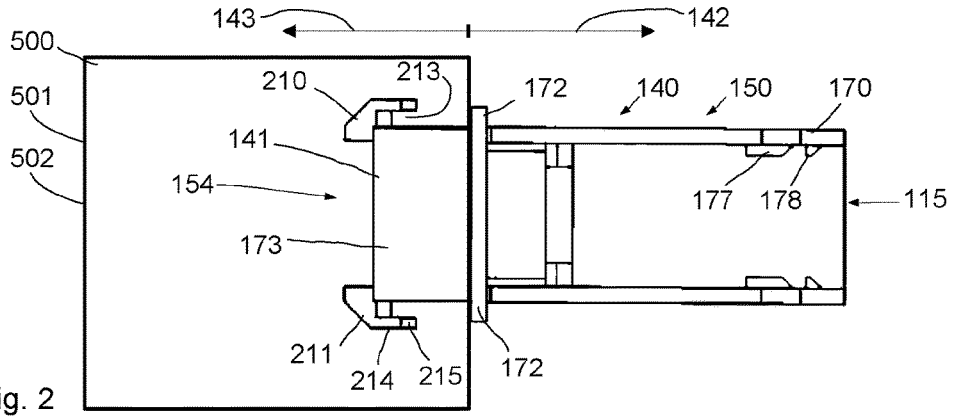
FIG. 2 a schematic plan view of a wall of an electrical component having a terminal enclosure accommodated thereon.

FIG. 2 is a highly schematized plan view of an electrical component 500 having a wall 502 upon which a connecting terminal 100 is accommodated, of which, for the sake of clarity, only outer enclosure 170 is shown in FIG. 2. Lugs 177 and 178, which lockingly engage inner enclosure 160 during assembly, are provided in the interior space of outer enclosure 170.

Discernible in FIG. 2 is the form of latching units 210, which are configured as latching arms 211. The limbs of latching arms 211, which extend outwardly away from clamping enclosure 150, are covered here by the supporting wall, which also acts as a counter bearing element 173. The width of supporting wall 173 corresponds here exactly to the outer interspacing of the two latching arms 211 that are discernible in FIG. 2. As will still be clarified with reference to FIG. 4, this ensures that the latching arms are, in fact, able to briefly elastically swivel inwardly during installation on wall 502, but are later held outwardly by latching units 220 that cooperate with the latching arms, so that the cross section of wall leadthrough 154 remains open.

Figure 3:
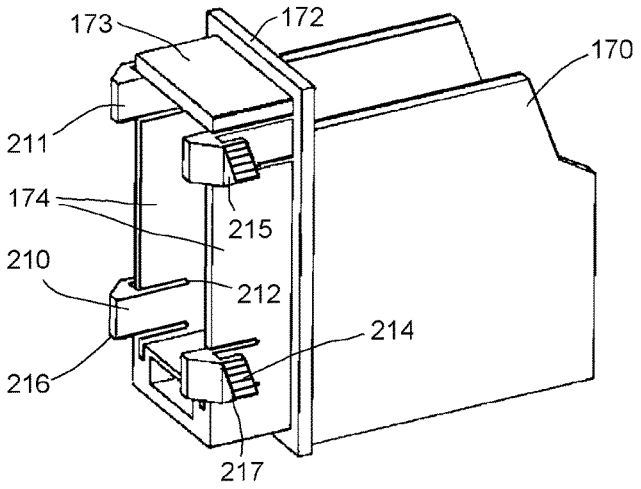
FIG. 3 a perspective view of a terminal enclosure.

FIG. 3 is a perspective view of terminal enclosure 150, respectively of outer enclosure 170 thereof, including first housing section 140 on a first side 142 of installation section 172 and thus outside of electrical component 500. Second housing section 141 is configured on second side 143 within enclosure 501. Second housing section 141 is used here as a fastening portion on which counter bearing elements 173, together with latching arms 211 and walls 174, provide a peripherally extending wall. This mechanically protects the inner space of second housing section 141 from influences and contacts when, for example, actuating device 103 enters partially into second housing section 141.

At unattached ends 216 thereof, latching arms 211 have more or less a U-shaped configuration. Between rearwardly extending limbs 215 and latching arm 211, a slot 213 is provided into which part of latching unit 220 enters.

Provided on outer transverse surface 214 is an engagement unit 217 which is configured here as a latching toothing segment or which includes a plurality of latching teeth. Latching toothing segments 217 on opposite latching arms 211 are configured on the outer surfaces that face away from each other and each reside transversely to transverse direction 204 (compare FIG. 4). The outer surfaces may be configured orthogonally to transverse direction 204, but are configured at a small angle of between 0° and 30° thereto.

Slots 212 between the side wall and latching arms 211 allow latching arms 211 to deflect elastically during assembly.

FIG. 4 shows a connecting terminal 100 mounted on a wall 502 of an electrical component 500 where a portion of second housing section 141 of terminal enclosure 150 is schematically visible behind wall 501. In general, however, terminal enclosure 150 is also suited for other electrical connecting terminals.

To attach connecting terminal 100, a latching system 201 is provided that includes four latching units 210 and four latching units 220 here. Latching units 210 are configured here as latching arms 211 that are elastically accommodated on terminal enclosure 150 and extend toward the unattached end 216 thereof. There, latching arms 211 have a U-shaped form, so that latching slot 213 is suited for receiving latching units 220. Latching units 220, configured as latching connectors 221, may be individual, separate parts, as illustrated in FIG. 4, or they may be interconnected by a flexible connector 225 or a clip, for example, as shown in FIG. 5 in an enlarged view.

Each latching connector 221 has a latching member 222 that has a more or less wedge-shaped structure 223 for thereby effecting a clamping to walls 502 of different thicknesses.

For the installation, second housing section 141 of terminal enclosure 150 is inserted through the opening in wall 502, the elastic latching arms 211 thereby briefly elastically inwardly deforming when particular latching arm 211 passes wall 502. Subsequently thereto, latching arms 211 snap outwardly again. It is then not possible to readily remove terminal enclosure 150 again. To fasten terminal enclosure 150, latching units 220 are then snapped on. Via slot 226 thereof, latching connectors 221 are thereby snapped onto limbs 215 of latching arms 211, enabling latching elements 217 on transverse surface 224 to form a latched connection with latching toothing segment 227 on latching connectors 221. In response to movement of latching connectors 221 in latching direction 202, the ends of latching arms 211 are clamped by wedge-shaped latching members 222 of latching connectors 221 and pressed away from wall 502. Thus, a secure hold may be ensured when working with different wall thicknesses or wedge-shaped or stepped walls 502. Latching toothing segment 227 thereby extends transversely to the connection direction. Latching toothing segments 217 and 227 are provided on transverse surfaces 214, respectively 224, which, in the assembled state, rest against each other.

Individual clamping is carried out here at each of the four individual latching arms 211, so that even different wall thicknesses of individual latching arms 211 do not play a role.

In the assembled state, as illustrated in FIG. 4, supporting wall 173 acts as a counter bearing element, against which adjacent latching arms 211 are braced. It is thus ensured that wall leadthrough 154, respectively the space between supporting walls 173 remains open. In the case that an elastic latching arm 211 does not bend elastically outwardly again on its own upon introduction thereof into wall 502, latching arm 211 is pulled outwardly by latching connectors 221 since, as counter bearings, latching connectors 221 are braced by latching members 222 thereof against supporting wall 173.

Thus, a reliable operation of connecting terminal 100 may be ensured since, upon repositioning of actuating device 103 from contact position 145 to open position 144, clamping spring 101 and other components of the actuating device are partially swiveled through wall leadthrough 154. It must, therefore, be ensured that the installation space in the interior of electrical component 500 occupied by second housing section 141 does not present an obstacle to the swiveling motion.

FIG. 6 is a schematic perspective view of an open connecting terminal 100 without an outer enclosure 170, but with an installed inner enclosure 160 of plastic, upon which holder 108 of metal is accommodated. Holder 108 of connecting terminal 100 has an approximately U-shaped cross section and is composed here of a bent stamped part. Current bar 110 is accommodated on holder 108.

Connecting terminal 100 is illustrated in open position 144, in which a conductor to be connected may be pivoted into position from above into conductor receptacle 115. A conductor may also be optionally inserted from the front.

On conductor receptacle 115, oblique portions 161 and 162 are provided as an insertion aid in the plastic wall of inner enclosure 160. Latching openings 165 and 166 on lateral outer walls are provided for receiving lugs 177 and 178 on the inner walls of outer enclosure 170, whereby the terminal enclosure is self-locked.

Actuating device 103 is covered by a protective cover 153. Provided on protective cover 153 is closure segment 149 that closes a gap 148 between installation wall, respectively installation section 172 and wall leadthrough 154 in contact position 145. In open position 144, deflector 155 closes gap 148. In contact position 145, wall 185 upwardly covers conductor receptacle 115. Moreover, wall 185 may bound an insertion funnel for a tool. Such an insertion funnel may be provided when lateral walls join deflector 155 and wall 185, so that tool receptacle 109 is surrounded by walls in the manner of a funnel.

Laterally discernible is an opening 158 on protective cover 153 with which an insert device 118 having projections 157 is latched from the inside.

In conductor receptacle 115, a push-through protection 117 is provided that prevents a conductor to be connected from being inserted too deeply. Push-through protection 117 is configured on a slot 116 (compare FIG. 9) and prevents an inserted conductor from being pushed through and, in addition, secures current bar 110 within holder 108.

Discernible, moreover, are clamping lever 102 together with clamping edge 122, as well as auxiliary lever 104 along with cross connector 105. Auxiliary lever 104 is rotatably received on holder 108 about the axis of pin 151. Of insert device 118, only plug-in protection 156 is discernible here which, in open position 144, reliably prevents a conductor from being inserted into the region of clamping spring 101 above conductor receptacle 115.

Figure 7:
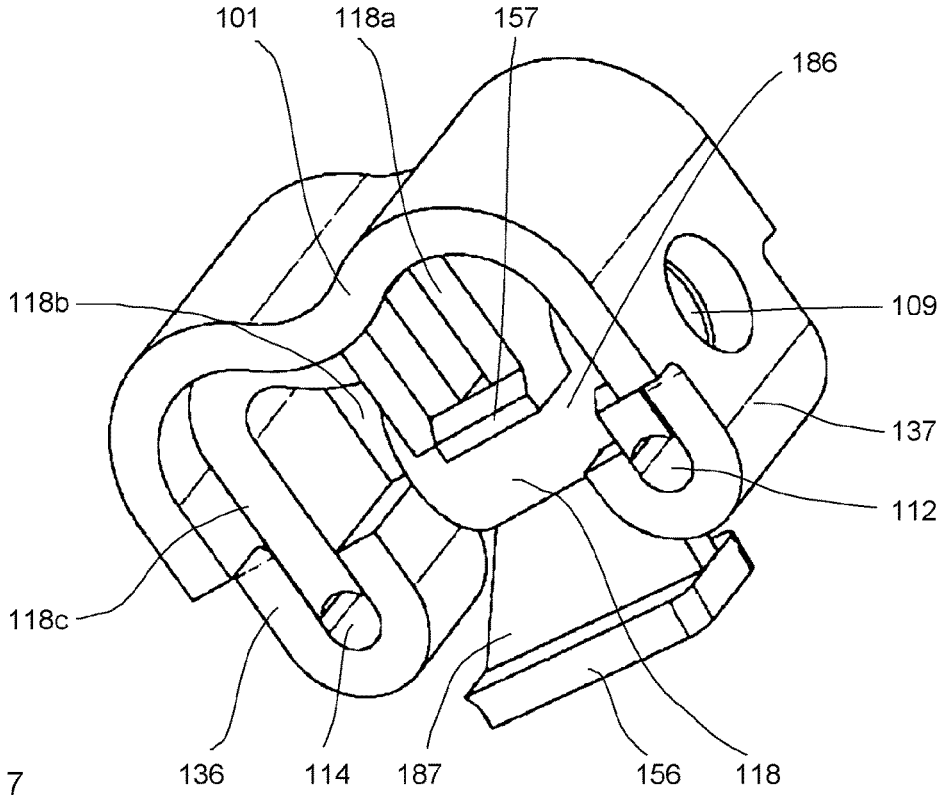
FIG. 7 the insert device and the clamping spring of the connecting terminal according to FIGS. 1 and 6.

FIG. 7 shows insert device 118 on clamping spring 101. Insert device 118 is part of a multifunctional inner part 186. Inner part 186 includes insert device 118 having receiving opening 132 (compare FIG. 9) and plug-in protection 156, as well as the latching lugs in the form of projections 157 for fixing protective cover 153 in position. The two latching lugs 157 project laterally outwardly and lockingly engage with the two lateral openings 158 in protective cover 153.

Clamping spring 101 provides the requisite clamping force on connecting terminal 100. Clamping spring 101, whose form on the whole is approximately C-shaped in the lateral view, has an insert device 118 configured here as a plastic insert inside of the "C" and is used as a counter bearing for a tool 120 (compare FIG. 9) upon actuation of connecting terminal 100. Clamping spring 101 is tensioned here, so that, when subject to load, the two limbs 136 and 137 of clamping spring 101 move apart. The "C" is open toward conductor receptacle 115.

Figure 8:
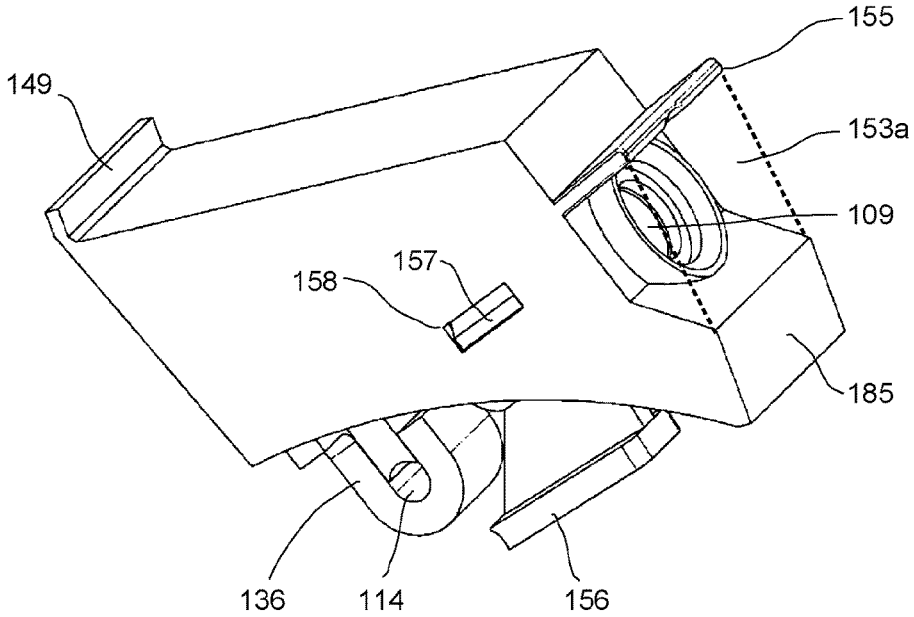
FIG. 8 a perspective view of the actuating device of the connecting terminal according to FIGS. 1 and 6.

Clamping spring 101 also serves here as actuating device 103, respectively as the actuating lever and, in addition to clamping spring 101, also includes the plastic insert and protective cover 153 illustrated in FIG. 8. Provided on second limb 137 of clamping spring 101 is a tool opening 109, through which a tool 120, such as a screwdriver, may be introduced in order to reposition connecting terminal 100 from open state 144 to clamping state 145 and back again in response to the movement of the screwdriver. Upon actuation, receiving opening 132, respectively the wall surrounding the same in insert device 118 is used as a counter bearing. Insert device 118 has an insert element 118*a*, in particular an elastically formed holding limb 118*c* and a gap 118*b* therebetween. This allows insert device 118 to rest against the two limbs 136, 137 of clamping spring 101 in response to spring movements as well. Holding limb 118*c* may be fixedly coupled to first limb 136 of clamping spring 101 or clamped thereto.

Discernible are second pivot 114 at first limb 136 of clamping spring 101 and pin 112 at second limb 137. Projections 157 lockingly engage with openings 158 in protective cover 153. Via a crosspiece 187, plate-shaped plug-in protection 156 is joined, in particular in one piece, to insert element 118*a*.

FIG. 8 shows clamping spring 101 including insert device 118 and installed protective cover 153. Discernible at opening 158 is projection 157 of insert device 118. Visible at the bottom end to the rear is closure segment 149 and, at the top, deflector 155. When lateral walls are provided, as indicated by the dashed lines, an insertion funnel is provided for tool 120.

Figure 9:
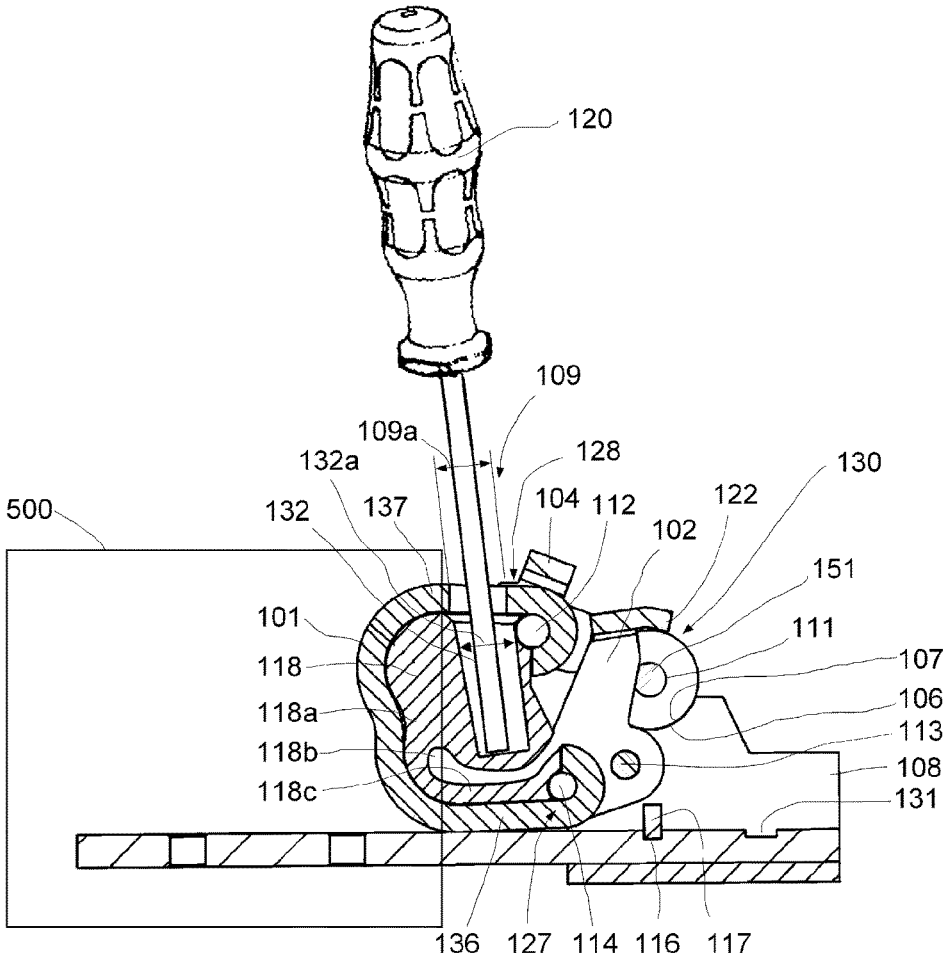
FIG. 9 a cross-sectional, schematic perspective view of the connecting terminal without an outer enclosure.

FIG. 9 is a schematic, cross-sectional side view of connecting terminal 100 having an insert device 118 that is configured as a plastic insert. Only holder 108 is illustrated, while terminal enclosure 150 is not shown in FIG. 9. By swiveling tool 120 clockwise, i.e., in the direction of clamping lever 102, electrical connecting terminal 100 is repositioned from open state 144 illustrated in FIG. 9 to clamping state 145.

First pivot 113 and second pivot 114 are accommodated on clamping lever 102. Overall, therefore, clamping lever 102 is pivotable about first pivot 113 accommodated on holder 108, so that, along with the pivoting of clamping lever 102, clamping edge 122 of clamping lever 102 is also pivoted.

First limb 136 of clamping spring 101 is rotatably accommodated on second pivot 114 of clamping spring 102. Second limb 137 of clamping spring 101 is pivotably mounted relative to first swiveling unit 129 (compare FIGS. 11 and 12) of auxiliary lever 104. Second swiveling unit 130 of auxiliary lever 104 is rotatably accommodated via round outer form 107 on round recess 106 of holder 108.

Figure 11:
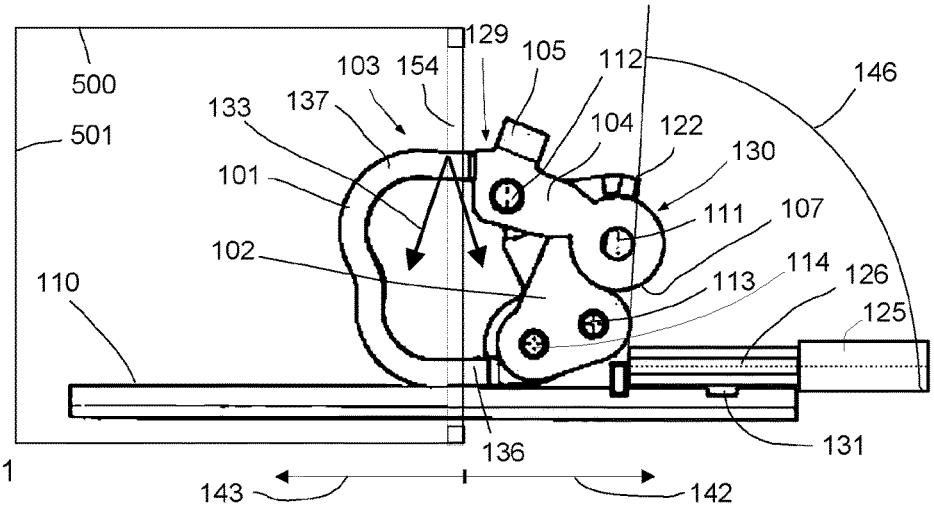
FIG. 11 a highly schematized lateral view of the connecting terminal in the open state.

Insert device 118 is shown in cross section in FIG. 9. The illustration omits plug-in protection 156 together with crosspiece 187 to make the other components more visible. A receiving means 132 for receiving a tool 120 is provided in insert device 118. Inner diameter 109*a* of tool opening 109 in the clamping spring is larger than inner diameter 132*a* of receiving opening 132 in plastic insert 118. This enables clamping spring 101 to be used for different insert devices 118, respectively with plastic inserts having different receiving openings 132. This makes it possible to provide different connecting terminals 100 where only insert device 118 differs, and thus the operating angle changes. FIG. 11 schematically shows two different angles that are indicated exemplarily by arrows 133.

Clamping lever 102 features two parallel side walls between which clamping edge 122 is provided. Clamping lever 102 is also configured here as a one-piece stamped bent part.

Current bar 110 features a slot 116 in which is configured a bar-shaped push-through protection 117 that is accommodated in corresponding lateral openings in walls 123 of holder 108. Current bar 110 is thereby axially secured and, moreover, a push-through protection for a conductor 126 is made possible.

Moreover, current bar 110 features a slot 131 that is situated where clamping edge 122 presses an inserted conductor 126 against current bar 110. This enables conductors 126 to be deformed into slot 131 during the clamping operation, thereby making it possible to ensure an effective pull-out protection.

In the sectional view of FIG. 9, first pivot receptacle 127 is discernible in cross section at first limb 136 of clamping spring 101. First pivot receptacle 127 thereby embraces second pivot 114 of clamping lever 102. Discernible in cross section at the other end of clamping spring 101, namely at second limb 137, is second pivot receptacle 128 which embraces pin 112 of first swiveling unit 129 of auxiliary lever 104.

Shown in cross section is guide pin 151 in hole 111, respectively the virtual axis of rotation of second swiveling unit 130 of auxiliary lever 104.

Figure 10:
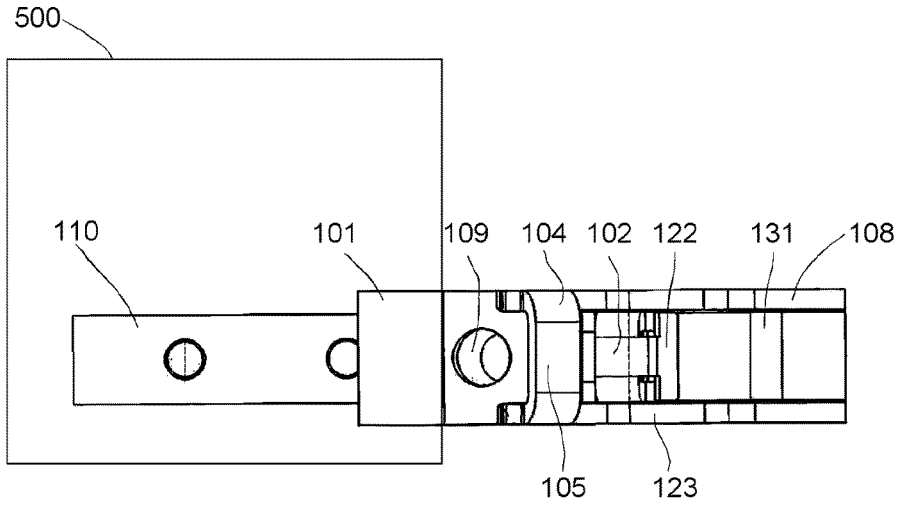
FIG. 10 a plan view of the connecting terminal according to FIG. 12.

FIG. 10 shows a plan view of electrical connecting terminal 100. Discernible on clamping spring 101 is tool opening 109. By cross connector 105 thereof, auxiliary lever 104 extends around second limb 137 of clamping spring 101. Clamping lever 102 features clamping edge 122, which is oriented here to the right and which, in the clamping state, engages into slot 131 or presses a conductor against slot 131 of current bar 110.

Figure 12:
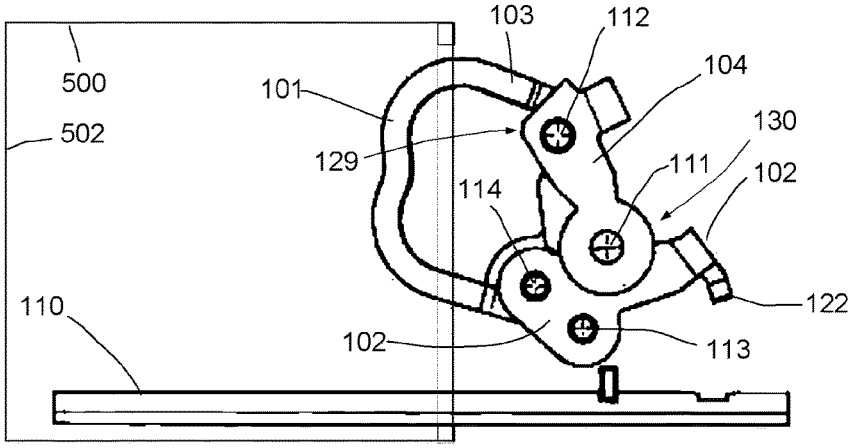
FIG. 12 a highly schematized lateral view of the connecting terminal in an intermediate position.
Figure 13:
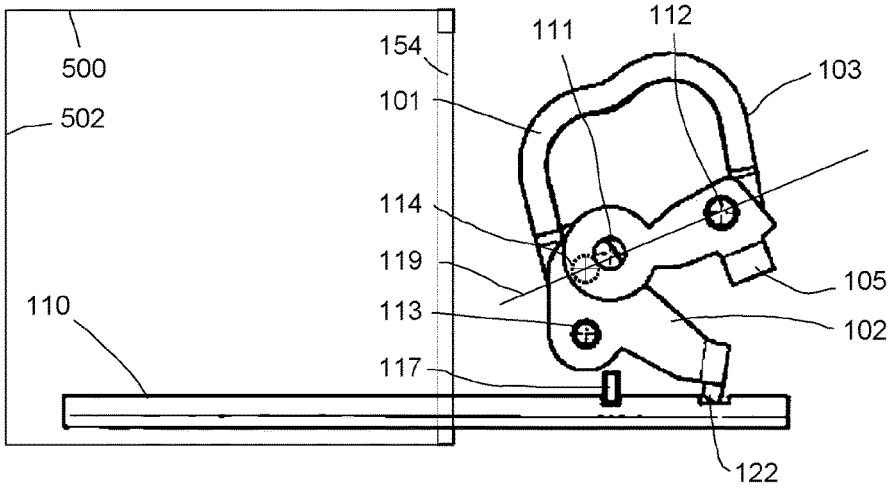
FIG. 13 a highly schematized lateral view of the connecting terminal in the clamping state.

With reference to FIG. 11 through 13, the operation of electrical connecting terminal 100 is explained in the following. Drawn schematically in FIG. 11 is a cable 125 having an electrical conductor 126. To be able to better clarify the operation, the illustrations of FIG. 11 through 13 omit various parts of electrical connecting terminal 100. Thus, FIG. 11 through 13 also omit terminal enclosure 150, as well as holder 108. However, it should be taken into account that clamping lever 102 is fixedly coupled via first pivot 113 to holder 108. Moreover, by round outer form 107 thereof, second swiveling unit 130 of auxiliary lever 104 rests immovably against recess 106 of holder 108 that is correspondingly formed in a round shape, namely against round recess 106 (not shown here) in holder 108.

To clarify the sequence of movements, an enclosure 501 of an electrical component 500 is indicated highly schematically and by a dashed line.

Opening angle 146 between current bar 110 and clamping edge 122 of clamping lever 102 here is much greater than 75° and nearly 90°. Depending on the geometric configuration of clamping lever 102, opening angle 146 may also be selected to be greater. Generally, however, this opening angle 146 suffices for pivoting especially rigid, large cross-sectioned conductors 126 into position from above into swivel-in region 115.

While FIG. 11 shows opening state 144, FIG. 12 shows an intermediate state where clamping lever 102 has already been considerably swiveled. This follows when a tool is introduced into tool opening 109 on clamping spring 101 and is swiveled clockwise in the illustration in accordance with FIG. 11 through 13.

When the transfer is made from the state illustrated in FIG. 11 to that illustrated in FIG. 12, the swiveling is carried out virtually without force since the interspacing of the two limbs 136 and 137 of the clamping spring 101 does not change or virtually does not change, so that the spring tension is virtually unchanged. An agreeable actuation is thereby achieved.

When working with conductors having very large cross sections, an engagement of clamping edge 122 on conductor 126 may be almost completely achieved in the state illustrated in FIG. 12. When the repositioning is carried out from the state illustrated in FIG. 11 to that illustrated in FIG. 12, clamping lever 102, clamping spring 101 and auxiliary lever 104 swivel in a mutually coupled configuration.

FIG. 13 shows clamping state 145. It is clearly discernible that a zero clamping is also attainable where even conductors having the smallest cross section may be clamped.

In FIG. 13, clamping edge 122 engages in slot 131 of current bar 110. In response to the pivoting from the state illustrated in FIG. 12 to clamping state 145 in accordance with FIG. 13, clamping spring 101 is tensioned, the distance of first limb 136 from second limb 137 thereby widening. Therefore, a high clamping force is generated by stable clamping spring 101.

A comparison of FIG. 11 through 13 reveals that, in contact position 145 according to FIG. 13, actuating device 103 is situated to a greater extent on first side 142 than in open position 144 according to FIG. 11 where actuating device 103 extends at least partially and clamping spring 101 even substantially through wall leadthrough 154 to second side 143. This means that, in open position 144, actuating device 103 and, in particular, clamping spring 101 enter at least partially into enclosure 501 of the electrical component. In open position 144, a substantial portion is located on second side 142 and thus within enclosure 501. Thus, a significant proportion of the volume, mass, and also of the cross-sectional area are located on second side 143. In contact position 145, actuating device 103 remains essentially or even completely on first side, respectively outer side 142.

This makes it possible to considerably reduce the space requirements of the connecting terminal. A portion of the required volume is used on the inner side of an electrical component, where there is typically enough space. This is especially the case when another connector is provided on the second side of connecting terminal. It is possible, for example, for the current bar to continue directly.

FIG. 13 shows a self-locked state. In response to the pivoting of clamping spring 101 and of auxiliary lever 104, a dead center is exceeded, so that, in clamping state 145, clamping spring 101 is slightly released in comparison with maximum bias. A stable state is thereby achieved. The self-locked state is discernible here in that connecting line 119 between pin 112 and second pivot 114 is barely below the center of hole 111, respectively the virtual axis of rotation of second swiveling unit 130 of auxiliary lever 104. As a result, upon repositioning of the electrical connecting terminal to open state 144, clamping spring 101 must initially be further biased to overcome the dead center.

Second pivot 114 is shown by a dashed line in FIG. 13 since it is located behind second swiveling unit 130 of auxiliary lever 104 and, therefore, would actually not be visible in this illustration.

Overall, therefore, a very advantageous electrical connecting terminal 100 is provided. The connecting terminal is capable of being connected in series and may be manufactured from simple components.

Electrical connecting terminal 100 configured as a rocker lever clamp features a dynamic lever transmission where, at the beginning of the closing operation, a long displacement path is covered by clamping edge 122, and where, upon further closing, a relatively long displacement path is covered by the tool while expending little force, which is converted into a high clamping force.

Clamping spring 101, and also clamping lever 102 and auxiliary lever 104, as well as holder 108 may be manufactured from stamped bent parts. This makes possible a simple and cost effective manufacturing, for mass production as well. Maximum opening angle 146 may be dimensioned to be very large, allowing even the most massive conductors to be swiveled into position into upwardly open swivel-in region 115.

Settling phenomena in the spring or other components are reliably avoided, and, generally, any level of clamping forces may be applied by properly selecting the wall thicknesses of clamping springs 101 and the further dimensions.

For the mounting support of auxiliary lever 104, together with second swiveling unit 130, on holder 108, second swiveling unit 130 may have a round outer contour 107 that engages into recess 106 of holder 108 having a correspondingly formed round shape. This is possible since no tensile forces occur here, so that a simple plastic pin 151 of enclosure 150 suffices at hole 111.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS connecting terminal 100
clamping spring 101
clamping lever 102
actuating device 103
auxiliary lever 104
cross connector 105
recess 106
outer form 107
holder 108
tool opening 109
current bar 110
hole 111
pin 112
first pivot 113
second pivot 114
conductor receptacle, swivel-in region 115
slot 116
push-through protection 117
insert device 118
insert element 118*a*
gap 118*b*
holding limb 118*c*
connecting line 119
tool 120
clamping edge 122
side, wall 123
cable 125
conductor 126
first pivot receptacle 127
second pivot receptacle 128
first swiveling unit 129
second swiveling unit 130
slot 131
receiving opening 132
diameter 132*a*
arrow 133
first limb 136
second limb 137
first housing section 140
second housing section 141
first side, outer side 142
second side, inner side 143
open state, open position 144
clamping state, contact position 145
opening angle 146
gap 148
closure segment 149
enclosure, terminal enclosure 150
pin 151
protective cover 153
tool access 153*a*
wall leadthrough 154
deflector 155
plug-in protection 156
latching lug, projection 157
opening 158
inner enclosure 160
oblique portions 161, 162
latching opening 165, 166
outer enclosure 170
installation section, installation wall 172
counter bearing element, supporting wall, wall 173
wall 174
lug 177, 178
wall 185
multifunctional inner part 186
crosspiece 187
latching system 201
latching direction, first direction 202
transverse direction 204
latching unit 210
latching arm 211
slot 212, 213
transverse surface 214
limb 215
unattached end 216
engagement unit 217
latching unit 220
latching connector 221
latching member 222
wedge-shaped form 223
transverse surface 224
clip/connector 225
slot 226
latching toothing segment 227
electrical component 500
enclosure 501
wall 502

The invention claimed is:

1. A connecting terminal for an electrically contacting connection of at least one conductor to a current bar accommodated on a holder, the connecting terminal comprising:

an actuating device including a clamping spring in a form of a tension spring having a first limb and a second limb, the clamping spring being configured to apply a clamping force for clamping the conductor; and an insert device disposed between the first limb and the second limb of the clamping spring, the insert device configured to provide a counter bearing for a tool in response to the actuation of the actuating device;

wherein the insert device includes a receiving opening configured to receive a tool, and wherein the receiving opening provides the counter bearing.

2. The terminal of claim 1, wherein different insert devices are provided that make possible different operating angles.

3. The terminal of claim 1, wherein an inner diameter of a tool opening configured on the clamping spring is larger than an inner diameter of the receiving opening.

4. The terminal of claim 1, wherein the insert device rests against the first limb and/or the second limb.

5. The terminal of claim 1, wherein the insert device includes an insert element and a holding limb that extends away from the insert element, forming a gap.

6. The terminal of claim 1, wherein the actuating device has a protective cover configured for covering purposes in which an operating opening is provided for introducing a tool.

7. The terminal of claim 6, wherein the insert devices includes a latching lug configured to latch the protective cover in position being provided on the insert device.

8. The terminal of claim 1, wherein the insert device and/or the protective cover comprise a plastic.

9. The terminal of claim 1, wherein the actuating device includes a plug-in protection.

10. The terminal of claim 1, wherein the clamping spring has an approximately C-shaped form, and wherein an open area between the first limb and the second limb is are oriented toward a conductor receptacle.

11. The terminal of claim 10, wherein the open area between the first limb and the second limb is are at least substantially covered by the plug-in protection.

12. The terminal of claim 9, wherein the plug-in protection is joined via a crosspiece to the insert element of the insert device.

13. The terminal of claim 1, wherein the clamping spring is articulated by the first limb to a clamping lever and by the second limb to an auxiliary lever, and wherein the clamping lever and the auxiliary lever are pivotably mounted on a holder.

14. The terminal of claim 13, wherein the clamping lever includes a first pivot and a second pivot that is spaced at a distance from the first pivot, wherein the clamping spring includes a first pivot receptacle and a second pivot receptacle that is spaced at a distance from the first pivot receptacle, and wherein an auxiliary lever is provided that includes a first swiveling unit and a second swiveling unit that is spaced at a distance from the first swiveling unit.

15. The terminal of claim 1, wherein on the conductor receptacle, an opening angle between the current bar and the clamping lever in an open state is greater than 45°.

16. The terminal of claim 1, wherein on the conductor receptacle, an opening angle between the current bar and the clamping lever in an open state is greater than 60°, and preferably greater than 75°.

17. The terminal of claim 1, wherein on the conductor receptacle, an opening angle between the current bar and the clamping lever in an open state is greater than 75°.

18. The terminal of claim 1, wherein the insert device and/or the protective cover comprise an insulation material.

19. A connecting terminal for an electrically contacting connection of at least one conductor to a current bar accommodated on a holder, the connecting terminal comprising:

an actuating device including a clamping spring in a form of a tension spring having a first limb and a second limb, the clamping spring being configured to apply a clamping force for clamping the conductor; and an insert device disposed between the first limb and the second limb of the clamping spring, the insert device configured to provide a counter bearing for a tool in response to the actuation of the actuating device;

wherein the insert device includes an insert element and a holding limb that extends away from the insert element, forming a gap.

20. A connecting terminal for an electrically contacting connection of at least one conductor to a current bar accommodated on a holder, the connecting terminal comprising:

an actuating device including a clamping spring in a form of a tension spring having a first limb and a second limb, the clamping spring being configured to apply a clamping force for clamping the conductor; and an insert device disposed between the first limb and the second limb of the clamping spring, the insert device configured to provide a counter bearing for a tool in response to the actuation of the actuating device;

wherein the actuating device has a protective cover configured for covering purposes in which an operating opening is provided for introducing a tool.

* * * * *